United States Patent [19]

Robinson

[11] 4,185,421

[45] Jan. 29, 1980

[54] GUTTER PROTECTOR ASSEMBLY

[76] Inventor: Jackie Robinson, 118 Hillside St., Shelby, N.C. 28150

[21] Appl. No.: 971,795

[22] Filed: Dec. 21, 1978

[51] Int. Cl.[2] ..... E04D 13/04

[52] U.S. Cl. ..... 52/11; 52/27; 182/214; 248/482

[58] Field of Search ..... 52/11, 27; 182/107, 182/197, 198, 214; 248/48.1, 48.2

[56] References Cited

U.S. PATENT DOCUMENTS

| | | | |
|---|---|---|---|
| 1,393,922 | 10/1921 | Taylor | 182/214 |
| 1,502,490 | 7/1924 | Tack | 182/214 |
| 2,407,541 | 9/1946 | Ehnborn | 182/214 |
| 2,886,277 | 5/1959 | Boham et al. | 182/110 |
| 3,779,344 | 12/1973 | Rister | 182/214 |
| 3,853,202 | 12/1974 | Jarboe | 182/108 |
| 3,915,418 | 10/1975 | D'Amato | 52/11 X |

FOREIGN PATENT DOCUMENTS

| | | | |
|---|---|---|---|
| 745360 | 11/1966 | Canada | 52/11 |

*Primary Examiner*—Alfred C. Perham

*Attorney, Agent, or Firm*—Roy B. Moffitt

[57] ABSTRACT

Disclosed is a combination safety device and gutter protector for use with a ladder which is leaned at an angle to the wall of a house or the like, the upper ends resting laterally secure against a relatively narrow extending surface of the device and not against the outer edge of a gutter installed on the eave of a roof. The device of the invention serves to prevent slippage or other undesirable movement of a ladder when it is placed in position for use and is a support means supporting the ladder and its load directly to the fascia board of a house, rather than to the gutter. The device is an "H" shaped support means attached to a gutter backwall and to a fascia board and is composed of two spaced apart stanchions and a crossmember, each of the stanchions having a longitudinal passageway thereto and an elongated spike disposed in the passageway. One end of the spike protrudes through the gutter backwall and is embedded in the fascia board. A terminal portion of each stanchion and a free edge of said crosspiece protrudes beyond the free edge of the gutter forming a recess in which a ladder may be disposed.

6 Claims, 4 Drawing Figures

GUTTER PROTECTOR ASSEMBLY

BACKGROUND OF THE INVENTION

This invention relates to a safety device adapted to be secured to a wall of a structure, more particularly a fascia board of a house. The primary purpose of the device is to receive and laterally support and transfer a ladder, the load of the ladder itself and the load which the ladder is carrying directly to a wall of the structure to which the safety device is affixed. By so doing, the load in question is not transferred to a gutter, attached to a fascia board of a structure.

More particularly, the invention relates to a safety device designed to limit and prevent lateral slippage or similar movement of the upper end of a ladder, caused by normal body motion of a person standing on one of the rungs of the ladder when it is positioned to lean at an angle to the wall of a house or other building structure and at the same time transfer the ladder load to the structure wall and not to a gutter.

When a person desires to reach and gain access to an upper level of a vertical surface of a sidewall or the roof of a house, to make repairs for example, a person does so by placing a ladder of adequate height against the wall. More often than not, the ladder is positioned against a gutter, attached to the fascia board of the structure itself without any lateral restraints. Because of the nature of the construction of a gutter, the person ascending such a ladder faces the risk of falling from the ladder, with resultant physical injury. This risk is even greater when a person is standing on one of the uppermost rungs of a ladder whose upper end extends above the eave of the roof. In this event, the relatively narrow surfaces of the rails of the ladder usually laterally unrestrained rest against a relatively narrow, horizontally extending surface, as for example the outer edge of a gutter installed along the eave of the roof. Furthermore, the load of the ladder plus the person is on the gutter itself, both of which are undesirable.

PRIOR ART

A number of devices have been proposed by various artisans for dealing with the foregoing problem. These prior art devices have included those which are of the type designed to anchor a ladder by utilizing a suction cup, or a pointed element, or a suitable device to maintain frictional contact with the surface against which the ladder is supported in its leaning position. Clamping brackets have been proposed. In general, these clamp the wall engaging elements in a fixed or a rigid relationship, to the rungs or the side rails of the ladder. Typical of these proposed devices are those shown in patents to Taylor, U.S. Pat. No. 1,393,922; Pack, U.S. Pat. No. 1,502,490 and Boham, et al, U.S. Pat. No. 2,886,277 and Jarboe, U.S. Pat. No. 3,853,202.

SUMMARY OF THE INVENTION

The basic element of the invention is an "H" shaped member composed of two stanchion members affixed to one another by means of a crossmember. Each stanchion member has a passageway therethrough in which there is disposed a conventional spike (a large nail). The stanchion members are of a length whereby the terminal portion of the stanchion members nearest to the crossmember is adapted to protrude beyond the terminal free edge of a gutter. The crossmember is attached to the stanchions at a position so that the terminal free edge of the crosspiece also protrudes beyond the free edge of the gutter, the free edge and protruding stanchions forming a ladder recess. The other terminal portions of the stanchion members are adapted to abut against the fascia board of a structure. The safety device is affixed to the fascia board of a structure by means of spikes or nails and positioned so that a portion of a ladder may be rested against the crossmember (in the recess), the load of the ladder and that which the ladder carries being transferred directly to the fascia board, prohibiting any part of such load being transferred to the gutter.

Figure 1:
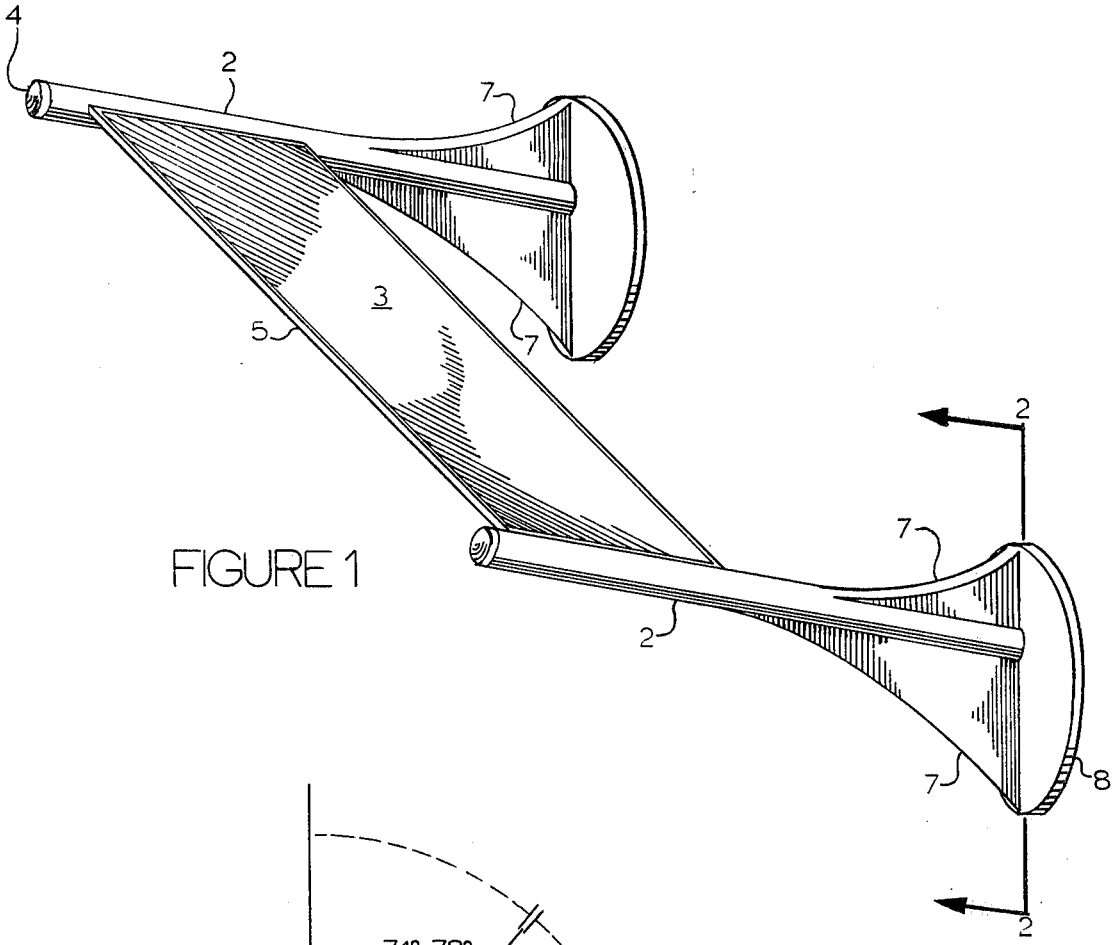
FIG. 1 is a perspective view of the "H" shaped safety device of the invention.

Generally shown by element 1 in FIG. 1 is the "H" shaped gutter protection and safety device of the instant invention. The device is made up of two hollow stanchion members 2 connected together in any convenient means by crossmember 3. Each stanchion member 2 is a hollow tube providing a passageway 9 through which nail 4 is disposed. Each stanchion member 2 is connected to a foot means 8 and is reinforceably attached to foot means 8 by support webbs 7. Crossmember means 3 has a free edge 5 spaced apart from the free end of stanchions 2 of the terminal portion of stanchions 2 shown generally by element 6. The space delineated by element 6 of each of the stanchions 2 and free edge 5 of the crossmember 3 form a recess, which is adapted to receive a ladder.

Figure 2:
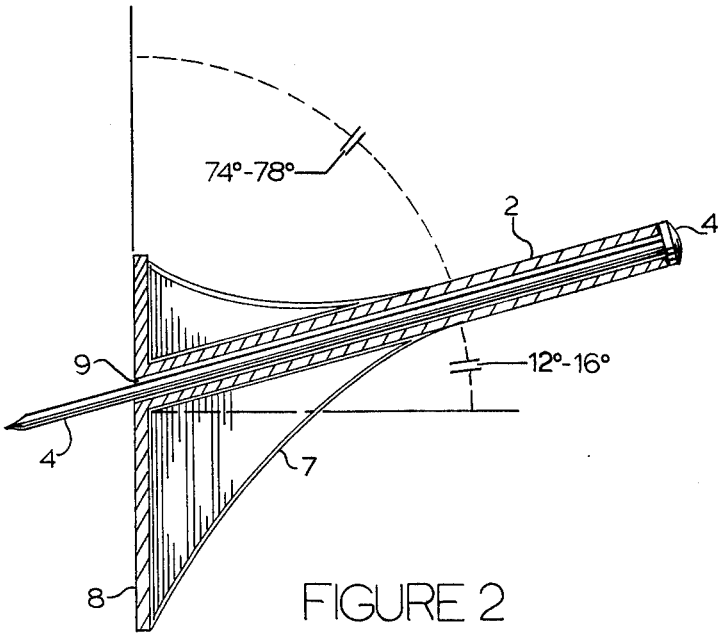
FIG. 2 is a crossection of the "H" shaped safety device along lines I—I of FIG. 1.

It will be noted that foot means 8 also has a passageway thereto communicating with the passageway through stanchion members 2, shown more clearly in FIG. 2. A nail or spike member 4 is disposed in passageway 9 through foot member 8 and adapted to be embedded in a fascia board of a structure, more clearly shown in FIG. 3.

FIG. 2 is a crossectional view of the stanchion member 2, showing foot means 8 and the angle it forms with stanchion member 2. In order that safety device 1 can be attached to the fascia board of a structure and be inherently disposed at a proper angle, namely 12 to 16 degrees with the horizontal, stanchion member 2 is attached to foot means 8 at an angle between 12 and 16 degrees as shown in FIG. 2.

Figure 3:
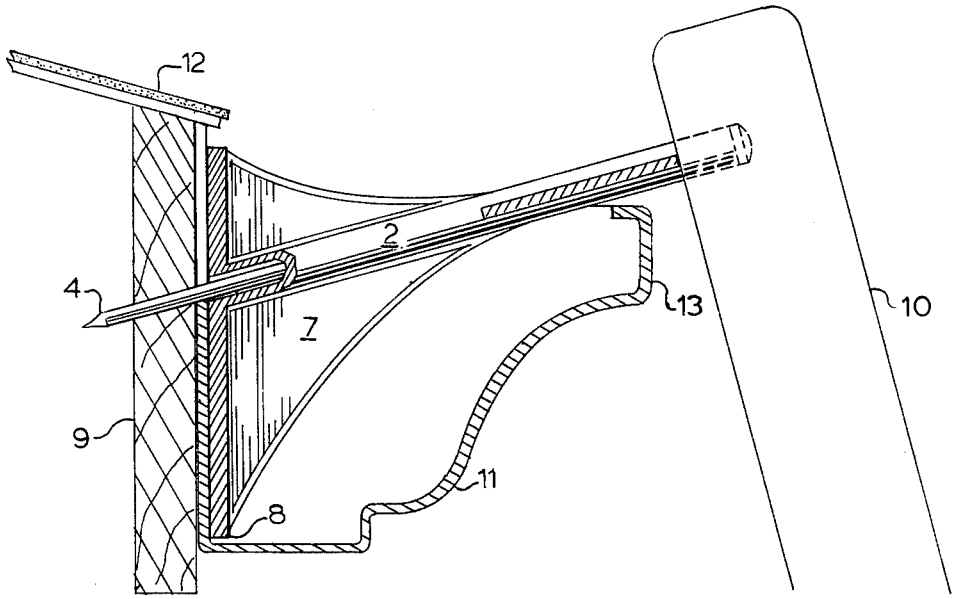
FIG. 3 is a crossectional view of a gutter and the "H" shaped safety device of FIGS. 1 and 2 attached to a fascia board of a structure, with a ladder resting against the safety device.
Figure 4:
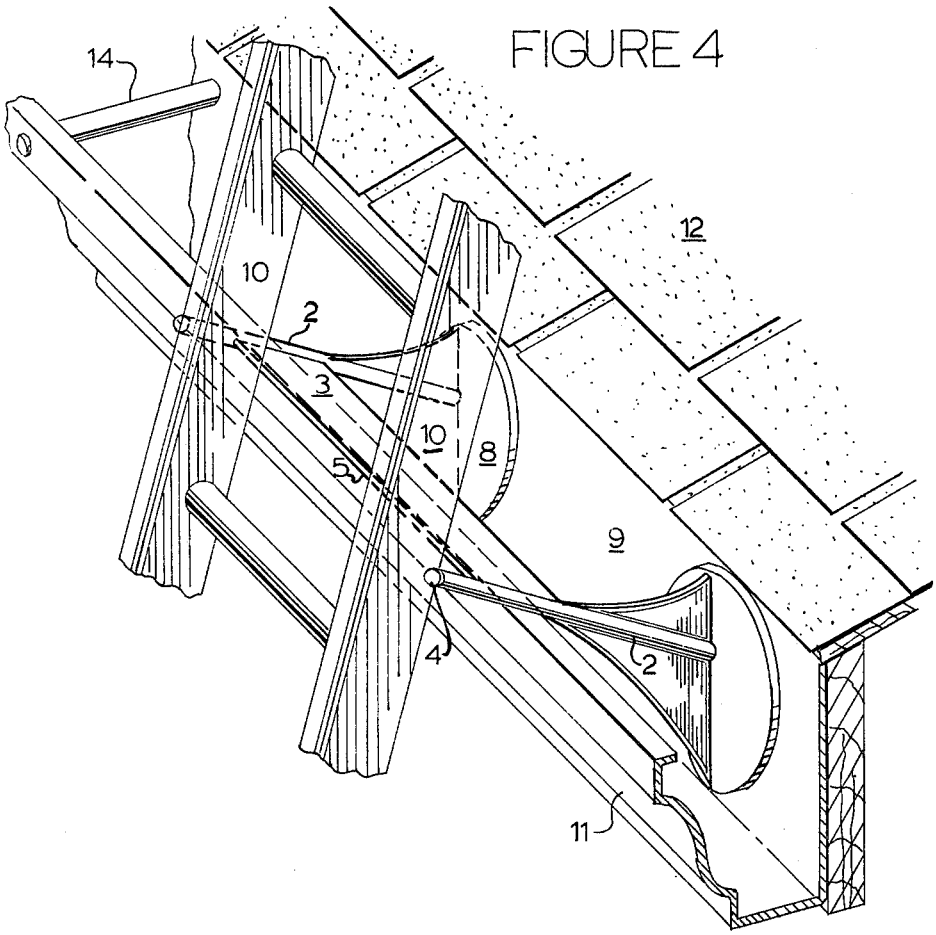
FIG. 4 is a perspective view of the gutter, fascia board safety device and ladder as shown in FIG. 3.

Referring to FIGS. 3 and 4, there is shown ladder 10 resting on the outermost free edge of a crossmember 3, namely element 5 (see FIG. 1). Also shown is safety device 1 affixed by nails 4 to fascia board 9, with foot means 8 being flush with fascia board 9. It will be appreciated that fascia board 9 is in close proximity with roof 12 and is also attached to gutter means 11. It will also be appreciated that the inherent construction of safety device 1, more particularly the angle at which stanchion means 2 are affixed to their respective foot means 8, results in the safety device being disposed at an appropriate angle so that the stancions 2 may protrude beyond the free edge 13 of the gutter means 11. The stanchions make an angle between 74 and 78 degrees with the fascia board (12° to 16° with the horizontal). Such an angle conforms with the normal safety rules applicable to placing of a ladder against a vertical wall in a safe manner. The normal rule for safe ladder placement is to place the base of the ladder a distance away from a wall equal to one-fourth the ladder projection. Stated in a different way, the angle that a ladder should make with the verticle is nominally 14 degrees, more particularly 14 degrees 30 minutes. The angle created by foot means 8 attached to stanchion means 2 in combination with a flush positioning of foot means 8 against fascia board 9 inherently results in a device upon which a ladder may be conveniently disposed at a safe angle. It will also be appreciated that the recess formed by terminal portions 6 of stanchions 2 and free edge 5 prevent any ladder 10 disposed in such recess from moving in a lateral fashion. Furthermore, the load of the ladder itself and any load carried by the ladder is transferred directly from the ladder to safety device 1 through stanchions 2 through the fascia board 9 and is never applied, directly or indirectly, to gutter 11. Free edge 5 of crossmember 3 protrudes beyond free edge 13 of gutter 11 and spaces apart ladder 10 from gutter free edge 13 to prevent any possible application of the load of the ladder itself against gutter 11.

FIG. 4 is a perspective view of the same combination of ladder, gutter, fascia board and safety device as that as shown in FIG. 3. Element 14 of FIG. 4 is a gutter attachment means which is commonplace in the art and is shown by elements 12 and 14 of U.S. Pat. 3,915,418 issued Oct. 28, 1975.

This invention is not limited to the specific details of construction shown herein and may be embodied in various other forms without departing from the spirit and scope of the claims.

I claim:

1. An "H" shaped gutter protection device composed of two parallel stanchions connected one to another by a crossmember, each of said stanchions having a longitudinal passageway therethrough adapted to receive a nail and each of said stanchions having a foot means attached thereto, said foot means having a flat portion disposed at an angle other than 90° to the longitudinal axis of said stanchion and a passageway therethrough in communication with the passageway in said stanchion.

2. The gutter protection device as set forth in claim 1, wherein said crossmember is attached to each of said stanchions a distance from the terminal free edges of said stanchions a distance less than one-half the length of said stanchions.

3. A gutter protection device as set forth in claim 1, wherein said angle is between 74 and 78 degress.

4. A gutter, fascia board, safety device combination comprising:

(a) a gutter, (b) a fascia board attached to the back sidewall of said gutter (c) an "H" shaped gutter protection device attached to said gutter backwall and to said fascia board composed of two spaced apart stanchions connected together by a crossmember, each of said stanchions having a longitudinal passageway therethrough and an elongated spike disposed therein, a terminal portion of said spikes protruding through said gutter backwall and embedded in said fascia board, one terminal portion of each stanchion and a free edge of said crossmember protruding beyond a free edge of said gutter, the other terminal portions of said stanchions abutting against the backwall of said gutter anf affixed thereto by means of said spike.

5. The gutter, fascia board, gutter protection device combination as set forth in claim 4 wherein the stanchions each have a foot means attached thereto, said foot means having a flat portion disposed at an angle other than 90° to the longitudinal axis of said stanchion.

6. The gutter, fascia board, gutter protection device combination as set forth in claim 5, wherein said angle is between 74 and 78 degrees.

* * * * *